US010415597B2

(12) United States Patent
Lyon

(10) Patent No.: US 10,415,597 B2
(45) Date of Patent: Sep. 17, 2019

(54) FLUID HEAT EXCHANGE SYSTEMS

(71) Applicant: COOLIT SYSTEMS, INC., Calgary (CA)

(72) Inventor: Geoff Sean Lyon, Calgary (CA)

(73) Assignee: CoolIT Systems, Inc., Calgary (CA)

( * ) Notice: Subject to any disclaimer, the term of this patent is extended or adjusted under 35 U.S.C. 154(b) by 596 days.

(21) Appl. No.: 14/924,686

(22) Filed: Oct. 27, 2015

(65) Prior Publication Data

US 2016/0146219 A1 May 26, 2016

Related U.S. Application Data

(60) Provisional application No. 62/069,293, filed on Oct. 27, 2014.

(51) Int. Cl.

| | |
|---|---|
| ***F04D 29/58*** | (2006.01) |
| ***F04D 1/00*** | (2006.01) |
| ***F04D 13/06*** | (2006.01) |

(52) U.S. Cl.

CPC ..... *F04D 29/5806* (2013.01); *F04D 1/00* (2013.01); *F04D 13/0606* (2013.01); *F04D 13/0673* (2013.01)

(58) Field of Classification Search

CPC ..... F04D 29/5806; F04D 13/0673; F04D 13/0606; F04D 1/00; F04D 29/58; H02K 9/19; H02K 9/193

See application file for complete search history.

(56) References Cited

U.S. PATENT DOCUMENTS 2,818,515 A * 12/1957 Dolenc ..... H02K 1/185 310/216.014
2,925,041 A * 2/1960 Miroslav ..... F04D 15/0094 310/63
3,073,385 A 1/1963 Martin
3,861,826 A 1/1975 Dean, Jr.
(Continued)

FOREIGN PATENT DOCUMENTS

EP 1808892 7/2007
JP 61032449 2/1986
(Continued)

OTHER PUBLICATIONS

USPTO Patent Trail and Appeal Board Final Written Dicision in Case IPR2015-01276 dated Dec. 8, 2016.
(Continued)

*Primary Examiner* — Peter J Bertheaud
*Assistant Examiner* — Dnyanesh G Kasture
(74) *Attorney, Agent, or Firm* — Ganz Pollard, LLC

(57) ABSTRACT

An electric pump can have a stator with a stator core defining a plurality of poles, a coil of electrically conductive material extending around each respective one of the plurality of poles, and a stator-cooling chamber, as well as an impeller coupled to a rotor. A first region can be at least partially occupied by the impeller and fluidicly coupled with the stator-cooling chamber to convey a working fluid from the first region into the stator-cooling chamber. The stator-cooling chamber can be configured to facilitate heat transfer from the stator core and/or the coils to the working fluid in the stator-cooling chamber. Cooling systems can incorporate such a pump. Related methods also are disclosed.

15 Claims, 7 Drawing Sheets

(56) References Cited

U.S. PATENT DOCUMENTS 4,139,330 A 2/1979 Neal
4,450,472 A 5/1984 Tuckerman et al.
4,561,040 A 12/1985 Eastman et al.
4,564,040 A 1/1986 Rudelick
4,750,086 A 6/1988 Mittal
4,758,926 A 7/1988 Herrell et al.
4,768,581 A 9/1988 Gotwald et al.
4,898,153 A 2/1990 Sherwood
4,909,315 A 3/1990 Nelson et al.
4,940,085 A 7/1990 Nelson et al.
5,016,090 A 5/1991 Galyon
5,070,936 A 12/1991 Carroll
5,099,311 A 3/1992 Bonde et al.
5,203,401 A 4/1993 Hamburgen et al.
5,218,515 A 6/1993 Bernhardt
5,265,670 A 11/1993 Zingher
5,277,232 A 1/1994 Borsheim
5,294,830 A 3/1994 Young et al.
5,309,319 A 5/1994 Messina
5,441,102 A 8/1995 Burward-Hoy
5,453,641 A 9/1995 Mundinger et al.
5,592,363 A 1/1997 Atarashi et al.
5,727,618 A 3/1998 Mundinger et al.
5,823,249 A 10/1998 Batchelder
5,998,240 A 12/1999 Hamilton et al.
6,019,165 A 2/2000 Batchelder
6,408,937 B1 6/2002 Roy
6,415,853 B1 7/2002 Tao et al.
6,415,860 B1 7/2002 Kelly et al.
6,447,270 B1 9/2002 Schmidt et al.
6,679,315 B2 1/2004 Cosley et al.
6,702,002 B2 3/2004 Wang
6,827,128 B2 12/2004 Philpott et al.
6,952,345 B2 10/2005 Weber et al.
6,986,382 B2 1/2006 Upadhya et al.
6,988,534 B2 1/2006 Kenny et al.
7,000,684 B2 2/2006 Kenny et al.
7,007,506 B2 3/2006 Kubo et al.
7,021,367 B2 4/2006 Oikawa
7,029,647 B2 4/2006 Tonkovich et al.
7,032,651 B2 4/2006 Winslow et al.
7,055,581 B1 6/2006 Roy
7,104,312 B2 9/2006 Goodson et al.
7,124,811 B2 10/2006 Crocker et al.
7,131,486 B2 11/2006 Goodson et al.
7,143,816 B1 12/2006 Ghosh et al.
7,156,159 B2 1/2007 Lovette et al.
7,190,580 B2 3/2007 Bezama et al.
7,201,217 B2 4/2007 Johnson et al.
7,206,203 B2 4/2007 Campbell et al.
7,209,355 B2 4/2007 Koga et al.
7,264,359 B2 9/2007 Kawahara et al.
7,274,566 B2 9/2007 Campbell et al.
7,301,771 B2 11/2007 Hata et al.
7,331,378 B2 2/2008 Bhatti et al.
7,360,582 B2 4/2008 Olesen
7,466,553 B2 12/2008 Hamman
7,527,085 B2 5/2009 Iijima et al.
7,688,589 B2 3/2010 Chiang
7,762,314 B2 7/2010 Campbell et al.
7,772,737 B1 * 8/2010 Fakonas ..... H02K 17/08 310/180
7,806,168 B2 10/2010 Upadhya et al.
7,971,632 B2 7/2011 Eriksen
8,051,898 B2 11/2011 Chiang
8,066,057 B2 11/2011 Olesen et al.
8,240,362 B2 8/2012 Eriksen
8,245,764 B2 8/2012 Eriksen
8,631,860 B2 1/2014 Tang et al.
9,453,691 B2 9/2016 Lyon
2002/0070007 A1 6/2002 Calaman et al.
2002/0189790 A1 12/2002 Wong
2003/0019234 A1 1/2003 Wayburn et al.
2003/0070792 A1 4/2003 Tanaka et al.
2003/0085028 A1 5/2003 Galtz
2003/0151130 A1 8/2003 Cheon
2003/0230400 A1 12/2003 McCordic et al.
2004/0040695 A1 3/2004 Chesser et al.
2004/0042171 A1 3/2004 Takamatsu et al.
2004/0042172 A1 3/2004 Kusaka et al.
2004/0104010 A1 6/2004 Kenny et al.
2004/0104012 A1 6/2004 Zhou et al.
2004/0104022 A1 6/2004 Kenny et al.
2004/0112585 A1 6/2004 Goodson et al.
2004/0123614 A1 7/2004 Stewart
2004/0182548 A1 9/2004 Lovette et al.
2004/0182560 A1 9/2004 Kenny
2004/0188066 A1 9/2004 Upadhay
2004/0206477 A1 10/2004 Kenny et al.
2004/0234395 A1 * 11/2004 Hatano ..... F04D 29/588 417/420
2005/0069432 A1 3/2005 Tomioka
2005/0178531 A1 8/2005 Huang et al.
2005/0205241 A1 9/2005 Goodson et al.
2005/0211417 A1 9/2005 Upadhay
2005/0241809 A1 11/2005 Tomioka et al.
2005/0269061 A1 12/2005 Brewer et al.
2006/0002011 A1 * 1/2006 Yamamoto ..... F16C 17/107 360/99.08
2006/0002088 A1 1/2006 Bezama
2006/0011329 A1 1/2006 Wang et al.
2006/0096738 A1 5/2006 Kang et al.
2006/0096740 A1 5/2006 Zheng
2006/0096743 A1 5/2006 Lee et al.
2006/0137863 A1 6/2006 Lee et al.
2006/0162903 A1 7/2006 Bhatti et al.
2006/0171801 A1 8/2006 Manabe et al.
2006/0185829 A1 8/2006 Duan
2006/0185830 A1 8/2006 Duan
2006/0225867 A1 10/2006 Park et al.
2006/0231238 A1 10/2006 Ball
2006/0254755 A1 11/2006 Chen et al.
2007/0029069 A1 2/2007 Duan
2007/0034356 A1 2/2007 Kenny et al.
2007/0036664 A1 * 2/2007 Shibui ..... F01D 25/125 417/407
2007/0039719 A1 2/2007 Eriksen et al.
2007/0131396 A1 6/2007 Yu et al.
2007/0163750 A1 7/2007 Bhatti et al.
2007/0183699 A1 * 8/2007 Shishido ..... F16C 17/107 384/107
2007/0193724 A1 8/2007 Lin
2007/0209784 A1 9/2007 Peng
2007/0227704 A1 10/2007 Nagai et al.
2007/0272392 A1 11/2007 Ghosh et al.
2008/0128114 A1 6/2008 Lai et al.
2008/0179045 A1 7/2008 Hu et al.
2009/0071625 A1 3/2009 Lyon
2009/0101315 A1 4/2009 Cheng
2009/0139698 A1 6/2009 Robinson
2010/0247342 A1 * 9/2010 Shimizu ..... F01D 15/10 417/410.1
2010/0252952 A1 * 10/2010 Pennington ..... B29C 35/0805 264/219
2010/0326634 A1 12/2010 Eriksen
2011/0008153 A1 * 1/2011 Kato ..... F04D 13/06 415/143
2011/0278971 A1 * 11/2011 Matsumoto ..... H02K 5/08 310/64
2012/0152498 A1 6/2012 Lyon
2012/0175094 A1 7/2012 Rice
2014/0042841 A1 * 2/2014 Rippel ..... H02K 1/20 310/54

FOREIGN PATENT DOCUMENTS

JP 2002151638 5/2002
JP 2007180505 7/2007
JP 2007227902 9/2007
JP 2007531991 11/2007
JP 06120387 4/2017
TW M273031 8/2005
TW M298733 8/2005

(56) References Cited

FOREIGN PATENT DOCUMENTS

| | | |
|---|---|---|
| WO | 2001065900 | 9/2001 |
| WO | 2005096377 | 10/2005 |
| WO | 2006052317 | 5/2006 |
| WO | 2006119761 | 11/2006 |

OTHER PUBLICATIONS

Osinski, USPTO Decision of Institution of Inter Parties Review, filed Dec. 9, 2015 in Case IPR2015-01276.
Pollard, USPTO Owner's Response, filed Mar. 9, 2016 in Case IPR2015-01276.
Petition for Inter Parties Review of U.S. Pat. No. 8,746,330 in Asetek Danmark A/S v. CoolIT Systems Inc., filed May 27, 2015.
Declaration of Dr. Donald Tilton (including his CV) from Petition fro Inter Parties Review of U.S. Pat. No. 8,746,330 in Asetek Danmark A/S v. CoolIT Systems Inc., dated May 27, 2015.
Knight, et al., "Heat Sink Optimization with Application to Microchannels," IEEE Transactions on Components, Hybrids, and Manufacturing Technology, vol. 15, No. 5, Oct. 1992, pp. 832-842.
Kandlikar, "High Flux Heat Removal with Microchannels—A Roadmap of Challenges and Opportunities," Heat Transfer Engr'g. 26(8):5-14 (2005).
Steineke, Mark E., et al., "Single-Phase Heat Transfer Enhancement Techniques in Microchannel and Minichannel Flows," Michrochannels and Minichannels—Jun. 17-19, 2004, Rochester, New York, USA (2004).
Preissuance Submission dated Jan. 9, 2015, U.S. Appl. No. 13/401,618.
Examination Report dated Mar. 11, 2011 in European Application No. 07075014.6, 9 pages.
Technical Opinion with English Translation dated Jan. 10, 2013 in Japanese Registration No. 3179086 (Utility Model Application No. 2012-002117), 7 pages.
Search Report and Examination with English Translation for Taiwanese Application No. 101110072, dated Apr. 9, 2014, 40 pages.
Office Action for U.S. Appl. No. 12/189,476, dated Apr. 13, 2012, 17 pages.
Final Office Action for U.S. Appl. No. 12/189,476, dated Jan. 7, 2013, 10 pages.
Centrifugal Pump Overview, Appendix B., http://nptel.ac.in/courses/112104117/ui/Course_home-8.htm, Jan. 5, 2018, pp. 1-10.
Musson, et al., "The Centrifugal Pump," Fundamentals of Fluid Mechanics, 1998, pp. 788-789, 3rd Edition, John Wiley & Sons, Inc., Canada.

* cited by examiner

FLUID HEAT EXCHANGE SYSTEMS

RELATED APPLICATIONS

This application claims priority from and benefit of U.S. Patent Application No. 62/069,293, filed Oct. 27, 2014, which patent application is hereby incorporated by reference in its entirety, for all purposes.

BACKGROUND

This application discloses subject matter pertaining to the disclosures in U.S. Patent Application No. 60/954,987, filed on Aug. 9, 2007, U.S. patent application Ser. No. 12/189,476, now U.S. Pat. No. 8,746,330, filed on Aug. 11, 2008, U.S. patent application Ser. No. 13/401,618, filed on Feb. 21, 2012, and U.S. Patent Application No. 61/512,379, filed on Jul. 27, 2011, each of which applications is hereby incorporated by reference in its respective entirety, for all purposes.

The innovations and related subject matter disclosed herein (collectively referred to as the "disclosure") generally pertain to fluid heat exchange systems, and more particularly, but not exclusively, to cooling of electric pump motors, with a system configured to cool a stator of an electric pump motor being but one particular example. Some systems are described in relation to electronics cooling applications by way of example, though the disclosed innovations may be used in a variety of other applications.

Fluid heat exchangers are used to cool electronic and other devices by accepting and dissipating thermal energy therefrom. A coolant (or other working fluid) is often conveyed throughout a fluid circuit including a fluid heat exchanger and a pump. Often, the pump is driven by an electric motor, with a brushless DC (BLDC) motor being an example.

In a typical DC motor, permanent magnets are arranged around an outer periphery of a spinning armature. In such a motor, the permanent magnets are stationary and form a stator, while the armature rotates and forms a rotor. The armature forms an electromagnet when current passes through the armature, creating a magnetic field that interacts with the permanent magnets of the stator.

By contrast, in a BLDC motor, the electromagnet forms the stator and plural permanent magnets are arranged to define a rotor. FIG. 7 shows a photograph of such a BLDC stator. In that photograph, the stator core 132 defines an inner, generally cylindrical portion and a plurality of radial arms extending outwardly of the inner portion. An electrically conductive wire is coiled about each of the radially extending arms to define a corresponding plurality of windings, or coils 136. The stator core 132 can be formed of a ferrous alloy or any material forming a magnetic field as a result of an electrical current passing through the coils 136. As a current passes through the coils 136, the resulting magnetic field can interact with the magnetic field of the permanent magnets of the rotor to urge the rotor in rotation around the stator core 132.

Electrical-resistive heating occurs as electrical current passes through the coils 136, heating the coils and the stator core 132. Long-term reliability, motor efficiency, and other measures of electric-motor performance can degrade over time when a temperature of the stator (e.g., the stator core 132 and the coils 136) exceeds a selected threshold temperature.

Despite the existence of many previously proposed fluid heat exchange systems, there remains a need for heat exchange systems configured to provide improved thermal performance for the electrical motors, and in particular, the stators, used in such systems. As well, there remains a need for such systems configured for existing and developing small form factors. For example, there remains a need for low-profile heat exchange assemblies (e.g., integrated heat sink and pump assemblies) configured to provide stator cooling and having a vertical component height of about 27 mm, such as between about 24 mm to about 27.5 mm, or less.

SUMMARY

The innovations disclosed herein overcome many problems in the prior art and address one or more of the aforementioned, or other, needs. The innovations disclosed herein pertain generally to fluid heat exchange systems and more particularly, but not exclusively, to approaches for cooling electric motors, with apparatus configured to cool stators of electric motors being but one particular example. For example, some innovations are directed to low-profile pump housings.

An electric pump can have a stator with a stator core defining a plurality of poles, a coil of electrically conductive material extending around each respective one of the plurality of poles, and a stator-cooling chamber, as well as an impeller coupled to a rotor. A first region can be at least partially occupied by the impeller and fluidicly coupled with the stator-cooling chamber to convey a working fluid from the first region into the stator-cooling chamber. The stator-cooling chamber can be configured to facilitate heat transfer from the stator core and/or the coils to the working fluid in the stator-cooling chamber.

In some instances, the first region includes at least a portion of an impeller chamber. Some electric pumps also have a housing defining a wall positioned between the first region and the stator-cooling chamber. The wall can define a first aperture configured to convey the working fluid from the first region into the stator-cooling chamber and a second aperture configured to convey the working fluid from the stator-cooling chamber into the first region.

A working fluid can occupy the first region and the stator-cooling chamber. A configuration of the first aperture can differ from a configuration of the second aperture. In some instances, the difference in configurations can give rise to sufficient pressure gradients within the working fluid to urge a flow of the working fluid through the stator-cooling chamber.

Some electric pumps also have a motor seal. The stator core can define an open interior region having one or more walls at least partially defining the stator-cooling chamber. The motor seal can matingly engage with the open interior region to provide a leak-resistant seal. The motor seal can also define one or more grooves configured to convey a working fluid over a region thermally coupled with the stator core. The housing wall, a cylindrical wall of the stator core, and the motor seal can define outer boundaries of the stator-cooling chamber.

The motor seal can define a groove extending around a perimeter of the motor seal. The groove can be configured to convey the working fluid through a flow path in direct contact with a wall defined by the stator core.

Some electric pumps also have a heat-transfer plate positioned within the stator-cooling chamber. The heat-transfer plate can be thermally coupled to the stator core and/or the coils and can define an effective heat-transfer area. The heat-transfer plate can have a plurality of extended heat-transfer features having an effective heat-transfer area greater than about twice an effective heat-transfer area of a heat-transfer plate lacking the plurality of extended heat-transfer surfaces.

Cooling systems for computer and/or server systems can incorporate disclosed electric pumps. As but one example, a pump can have an impeller and an electric motor. The electric motor can include a plurality of stator poles and a coil sufficiently arranged relative to each stator pole to impart an electro-magnetic field from the respective stator pole when supplied with an electric current. The electric motor can also include a plurality of permanent magnets coupled with the impeller and arranged relative to the stator poles to urge the impeller in rotation in response to the electro-magnetic fields from the stator poles. A heat exchanger can be arranged to receive a working fluid from the pump and to facilitate a transfer of heat between the working fluid and another medium. A housing can define one or more passageways configured to convey the working fluid from the pump to the heat exchanger and from the heat exchanger to an exhaust port. The pump can also include a stator-cooling chamber. The housing can define one or more passageways to convey the working fluid from the pump to the stator-cooling chamber. The stator-cooling chamber can be configured to facilitate a transfer of heat between the working fluid and the stator poles and/or the corresponding coils.

In some embodiments, the impeller has an inner course of circumferentially distributed straight impeller blades and an outer course of circumferentially distributed straight impeller blades positioned at least partially radially outward of the inner course of straight impeller blades.

In some embodiments, the one or more passageways defined by the housing to convey the working fluid from the pump to the stator-cooling chamber can include a plurality of apertures extending through a housing wall positioned between a region occupied by the impeller and the stator-cooling chamber. The plurality of apertures can be configured relative to each other to provide sufficient pressure gradients within the working fluid to urge the working fluid through the stator-cooling chamber. For example, a radial position or a cross-sectional area of one of the plurality of apertures differs from a radial position or a cross-sectional area of at least one other of the plurality of apertures.

Related methods also are disclosed. As but one example, a motor having a rotor and a stator is disclosed. The stator can have a stator core defining a plurality of stator poles and a coil corresponding to each respective one of the stator poles. The coils, the stator poles and the rotor can be sufficiently arranged relative to each other that an electro-magnetic field imparted to the stator poles by an electric current through the coils urges the rotor in rotation. A working fluid within a cooling system can be conveyed into a stator-cooling chamber thermally coupled with the stator poles and/or the corresponding coils. The working fluid can be conveyed over a surface of the stator-cooling chamber to facilitate heat transfer from the stator to the working fluid, thereby heating the working fluid and cooling the stator. The heated working fluid can be exhausted from the stator-cooling chamber and replaced with relatively lower temperature working fluid.

In some methods, the act of conveying the working fluid over a surface of the stator-cooling chamber includes the act of conveying the working fluid through a circumferentially extending groove of a motor seal.

The act of conveying the working fluid within the cooling system into the stator-cooling chamber can include the act of scavenging a flow of coolant from a cooling system. For example, a pump impeller physically coupled with the rotor can be urged in rotation, passing the coolant from a pump volute defined by a pump housing through a plurality of apertures defined by the housing into the stator-cooling chamber. The scavenged coolant can be conveyed over a wall thermally coupled with the stator poles and/or the corresponding coils. In some instances, the coolant can be conveyed over one or more extended heat transfer surfaces within the stator-cooling chamber.

It is to be understood that other innovative aspects will become readily apparent to those skilled in the art from the following detailed description, wherein various embodiments are shown and described by way of illustration. As will be realized, other and different embodiments are possible and several details are capable of modification in various other respects, all without departing from the spirit and scope of the principles disclosed herein.

Accordingly the drawings and detailed description are to be regarded as illustrative in nature and not as restrictive.

BRIEF DESCRIPTION OF THE DRAWINGS

Unless specified otherwise, the accompanying drawings illustrate aspects of the innovative subject matter described herein. Referring to the drawings, wherein like reference numerals indicate similar parts throughout the several views, several aspects of the presently disclosed principles are illustrated by way of example, and not by way of limitation, in detail in the drawings, wherein.

DETAILED DESCRIPTION

The following describes various innovative principles related to heat exchange systems by way of reference to specific examples. However, one or more of the disclosed principles can be incorporated in various system configurations to achieve any of a variety of corresponding system characteristics. The detailed description set forth below in connection with the appended drawings is intended as a description of various embodiments and is not intended to represent the only embodiments contemplated by the inventor. The detailed description includes specific details for the purpose of providing a comprehensive understanding of the principles disclosed herein. However, it will be apparent to those skilled in the art after reviewing this disclosure that one or more of the claimed inventions may be practiced without one or more of the illustrated and/or described details.

Stated differently, systems described in relation to particular configurations, applications, or uses, are merely examples of systems incorporating one or more of the innovative principles disclosed herein and are used to illustrate one or more innovative aspects of the disclosed principles. Thus, heat exchange systems having attributes that are different from those specific examples discussed herein can embody one or more of the innovative principles, and can be used in applications not described herein in detail. Accordingly, such alternative embodiments also fall within the scope of this disclosure.

Figure 1:
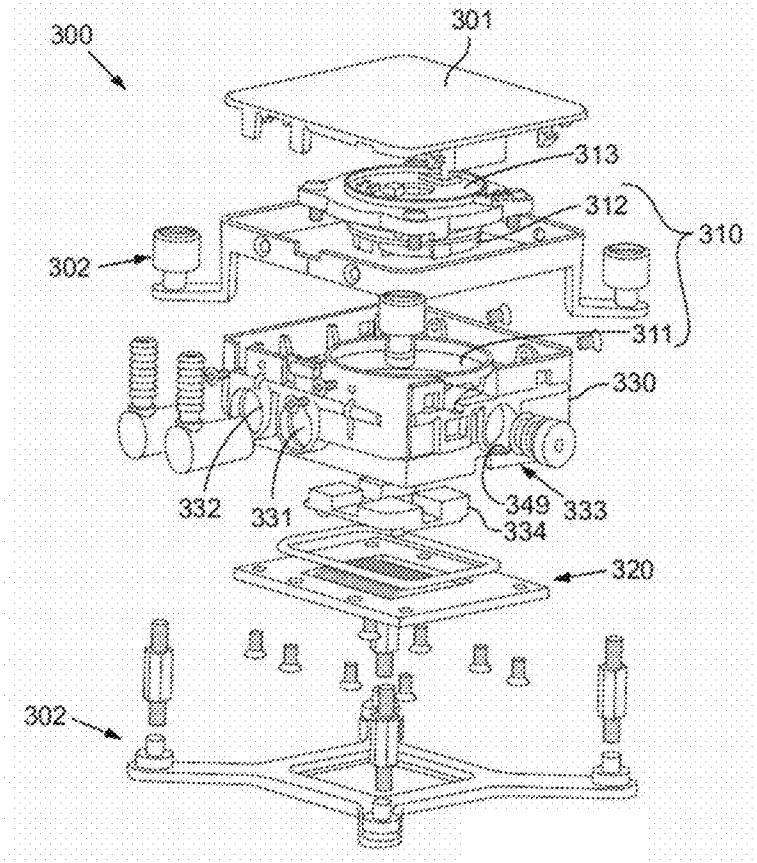
FIG. 1 illustrates an exploded view of an embodiment of an integrated pump and heat exchanger assembly.

The schematic illustration in FIG. 1 shows several features of a pump and heat exchanger assembly 300 similar to those assemblies described in U.S. patent application Ser. No. 13/401,618, filed on Feb. 21, 2012, and U.S. Patent Application No. 61/512,379, filed on Jul. 27, 2011. The assembly has a unitary housing 330 defining a flow path from an inlet port 331 to an outlet port 332. An electric motor 313 drives a centrifugal pump having an impeller 312 positioned within a pump volute 311. An outlet from the pump volute 311 delivers a working fluid to a passage arranged to convey the working fluid to a heat sink 320 and afterward through the outlet port 332. The pump drives the working fluid through a cooling circuit including, usually, a radiator or other heat exchanger configured to exchange energy in the form of heat with an environment. The working fluid then returns to the inlet port 331.

As used herein, the term "coupled" means linked together, connected, or joined with or without intervening or interposed structure. Thus, a first member coupled with a second member are linked together, connected together, or joined together in some fashion, with or without intervening or interposed structure. In one embodiment, as an example, the first and the second members could be in physical contact with each other. In another example embodiment, the first and the second members could be linked together by way of some intermediate member or assembly.

As used herein, the term "fluidic" means of or pertaining to a fluid (e.g., a gas, a liquid, a mixture of a liquid phase and a gas phase, etc.). Thus, two regions that are "fluidicly coupled" together are so coupled to each other as to permit a fluid to flow from one of the regions to the other region in response to a pressure gradient between the regions. Such fluidicly coupled regions can be fluidicly linked, connected, or joined together with or without intervening or interposed structure.

As used herein, the terms "working fluid" and "coolant" are interchangeable. Although many formulations of working fluids are possible, common formulations include distilled water, ethylene glycol, propylene glycol, and mixtures thereof.

As used herein, the terms "heat sink" and "heat exchanger" are interchangeable and mean a device configured to transfer energy to or from a fluid through convection (i.e., a combination of conduction and advection) heat transfer.

As used herein, the term "stator" means a stationary (relative to a fixed reference frame) member or assembly of an electric motor.

As used herein, the term "rotor" means a movable, often but not necessarily movable in rotation, (relative to the fixed reference frame) member or assembly of an electric motor.

Referring now to FIG. 1, a working example of an integrated subassembly 300 is described. The illustrated subassembly 300 comprises a pump 310 (e.g., impeller 312 and motor 313, exclusive of retention mechanism 302) and a solid-liquid heat exchanger 320, as well as a housing 330 having integrated fluid conduits extending there between. The subassembly 300 provides but one example of an approach for integrating several elements of a fluid circuit (not shown) e.g., a pump and a first heat exchanger, including an inlet manifold, several fluid passages, and an exhaust manifold, into a single element while retaining the several elements' respective functions, as described more fully, for example, in U.S. patent application Ser. No. 13/401,618. The illustrated housing 330 is configured to convey a working fluid from an inlet port 331 to a pump volute 311, from the pump volute to an inlet to the heat exchanger 320, and from an outlet of the heat exchanger to an outlet port 332. Other arrangements are possible.

The pump impeller 312 can be received in the pump volute 311. The impeller can be driven in rotation by an electric motor 313 and define an axis-of-rotation. A cap 301 can overlie the motor 313 and fasten to the housing 330 to provide the subassembly 300 with a finished appearance suitable for use with, for example, consumer electronics.

The side 333 of the housing 330 positioned opposite the pump volute 311 can receive an insert 334 and the heat exchanger 320. A seal (e.g., an O-ring) 323 can be positioned between the housing 330 and the heat exchanger 320 to reduce and/or eliminate leakage of the working fluid from the interface (or joint) formed between the heat exchanger 320 and the housing 330.

The heat exchanger 320 defines a lower-most face of the illustrated assembly 300, as well as a surface configured to thermally couple to an integrated circuit (IC) package (not shown). A retention mechanism 302 can mechanically couple the assembly 300 to a substrate, such as a printed circuit board to which the IC package is assembled.

A fluid conduit, or other fluid coupler, can fluidicly couple an outlet port of a remotely positioned heat exchanger to the inlet port 331 of the housing 330. As well, a fluid conduit, or other fluid coupler, can fluidicly couple the outlet port 332 of the housing 330 to an inlet port of the remotely positioned heat exchanger. In a cooling application (e.g., where the coolant absorbs heat as it passes over the heat sink 320), the respective fluid conduits convey relatively higher-temperature fluid from the outlet port 332 to the remote heat exchanger and relatively lower-temperature fluid from the remote heat exchanger to the inlet port 331.

Figure 2:
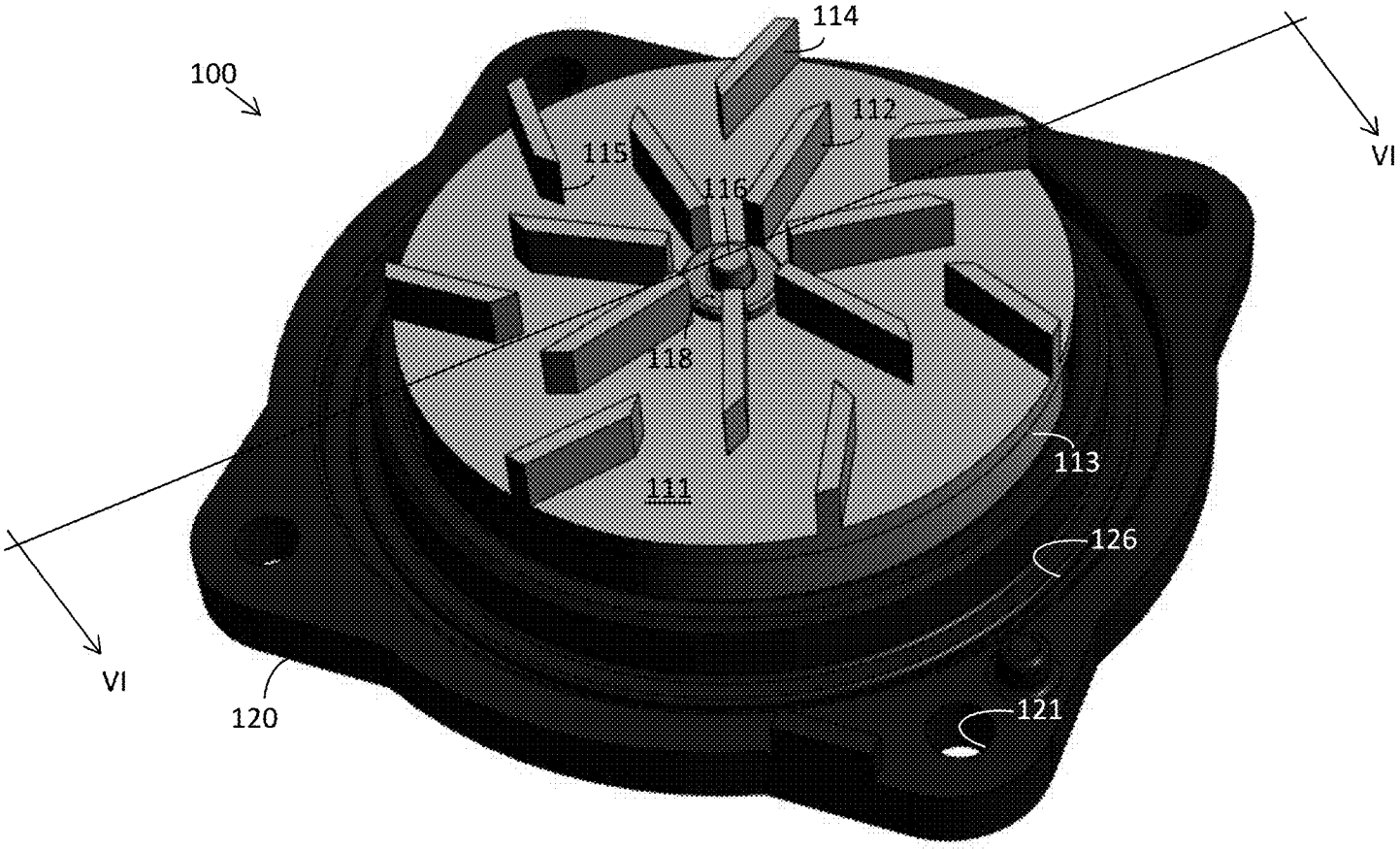
FIG. 2 illustrates an isometric view of an embodiment of an impeller and motor assembly of the type shown in FIG. 1.

Referring now to FIG. 2, an assembly 100 of a pump impeller 111 similar to the impeller 312 and an electric motor similar to the motor 313 is shown. The impeller can be received in the pump volute 311 and is exposed to the working fluid passing through the ump. The illustrated impeller 111 has an inner course of impeller blades 112 and an outer course of impeller blades 114. The outer course of impeller blades 114 can have an inner-most end defining a knife edge 115 to facilitate engagement of the blades with a working fluid passing over the blades.

The knife edge 115 can be positioned circumferentially between adjacent impeller blades 112 of the inner course. In one such embodiment, the knife edges 115 can be positioned radially inward of the radially outermost ends of the inner course of blades (e.g., such that the outer portions of the inner course of blades and the inner portions of the outer course of blades are juxtaposed). In another such embodiment, the knife edges 115 are positioned radially outward of the outer most ends of the inner course of blades. In still another embodiment, the knife edge can have a radial position approximately the same as the radial position of the outermost ends of the inner course of blades.

The inner course of blades, the outer course of blades, or both, can have any of a selected forward rake, rearward rake, or neutral rake. The degree of rake of the inner course of blades can be the same as or different than the degree of rake of the outer course of blades.

An impeller shaft 116 can be positioned at a center of rotation of the impeller 111, co-axially aligned with an axis-of-rotation of the impeller. An annular bushing (or bearing) 118 can be positioned between the shaft 116 and an innermost surface of a centrally positioned aperture in the impeller 116 to facilitate rotation of the impeller 111 about the shaft 116.

Figure 3:
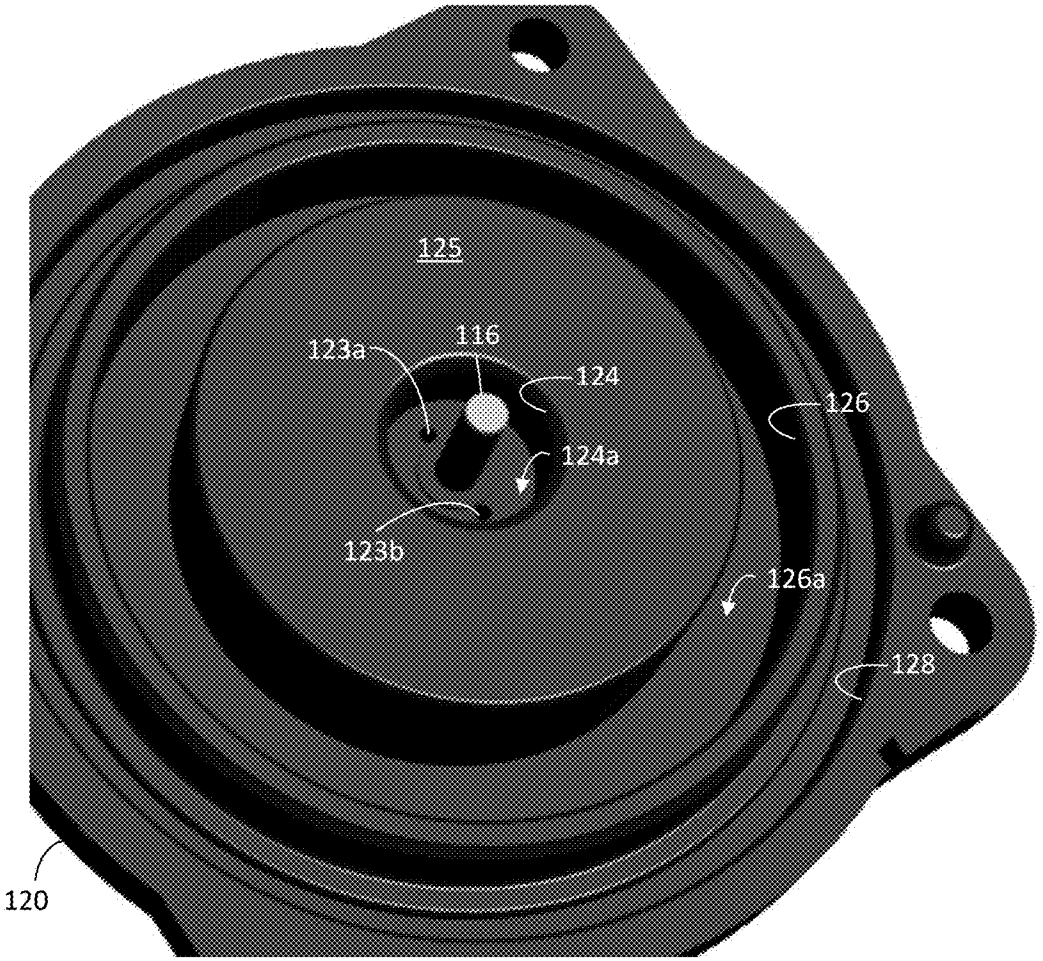
FIG. 3 illustrates an isometric view of the assembly shown in FIG. 2, with the impeller removed.
Figure 6:
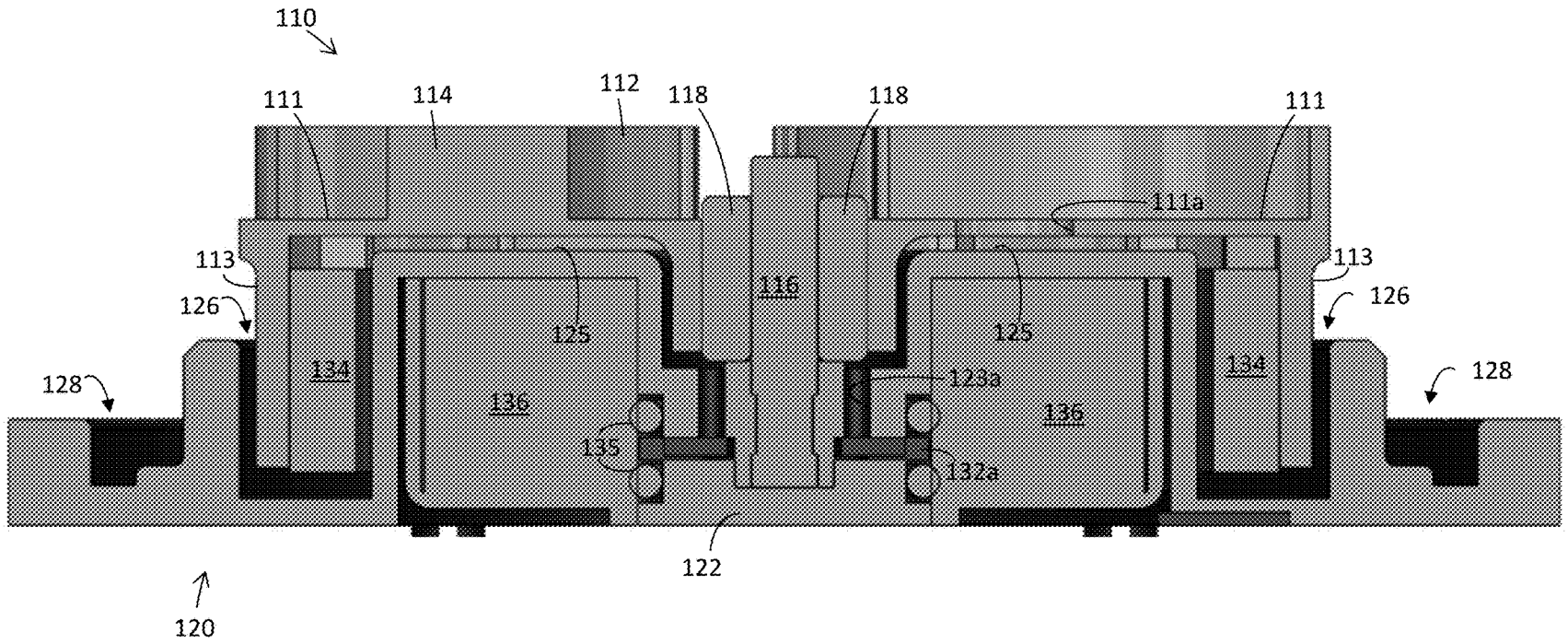
FIG. 6 illustrates a cross-sectional view along Section VI-VI in FIG. 2.
Figure 7:
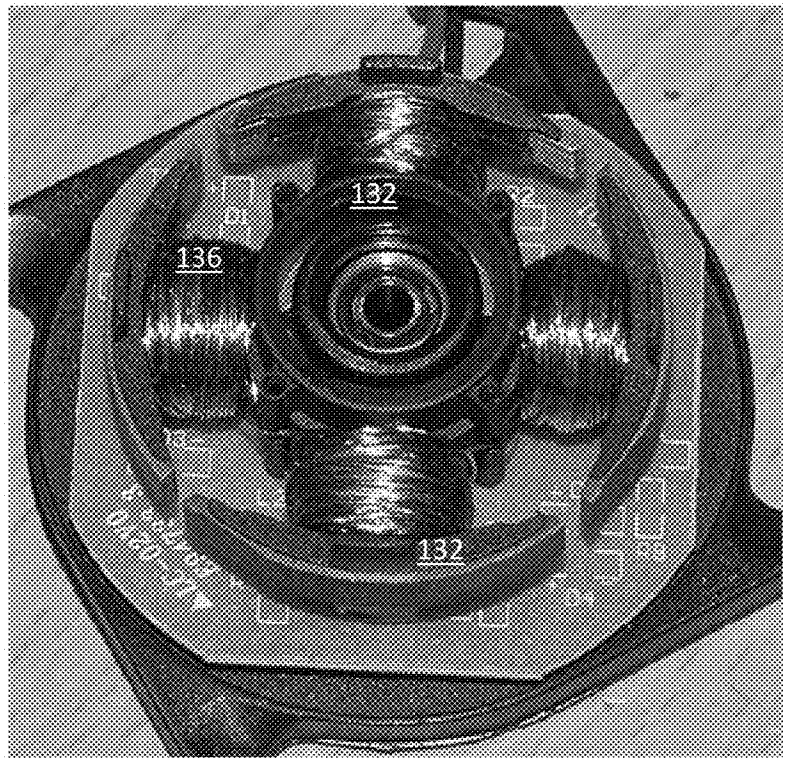
FIG. 7 shows a photograph of a brushless DC motor similar to the motor shown in FIG. 6.

As shown in FIG. 3, the housing 120 can define a centrally positioned cylindrical recess 124 having a floor 124*a*. The floor 124*a* can be exposed to working fluid during operation of the pump, as shown in FIG. 6 and explained more fully below. The shaft 116 can extend generally perpendicularly from the floor 124*a*. A longitudinal axis (not shown) of the shaft 116 desirably can be coextensive with a central axis defined by the cylindrical recess 124.

Radially outward of the central recess 124, the illustrated housing 120 can define an annular recess 126 coaxially arranged with the central recess 124. The annular recess defines a floor 126*a* extending between an inner wall of the recess 126 and an outer wall of the recess 126. The housing also can define an annular wall 125 spanning from an outer wall of the central recess 124 to the inner wall of the annular recess 126. Outward of the annular recess 126, the illustrated housing defines an annular groove 128 configured to receive a gasket or other sealing member (e.g., an O-ring) arranged to sealingly engage another housing member (e.g., the intermediate member 330 shown in FIG. 1).

The floor 124*a* of the central recess 124 defines, in the illustrated example, a pair of apertures 123*a*, 123*b* extending through the floor 124*a*. In other examples, more or fewer apertures are provided. The apertures can have other shapes, including by way of example an arcuate shape partially extending circumferentially about the shaft 116, or an annular shape extending entirely around the shaft. In any event, the apertures 123*a*, 123*b* can be arranged to permit a working fluid to flow through the floor 124*a* into a stator-cooling chamber defined by the stator subassembly (described more fully below). And, shown in FIG. 5, the working fluid can flow over a side of the housing opposite the floor 124*a*, as the fluid passes through the stator cooling chamber.

Figure 4:
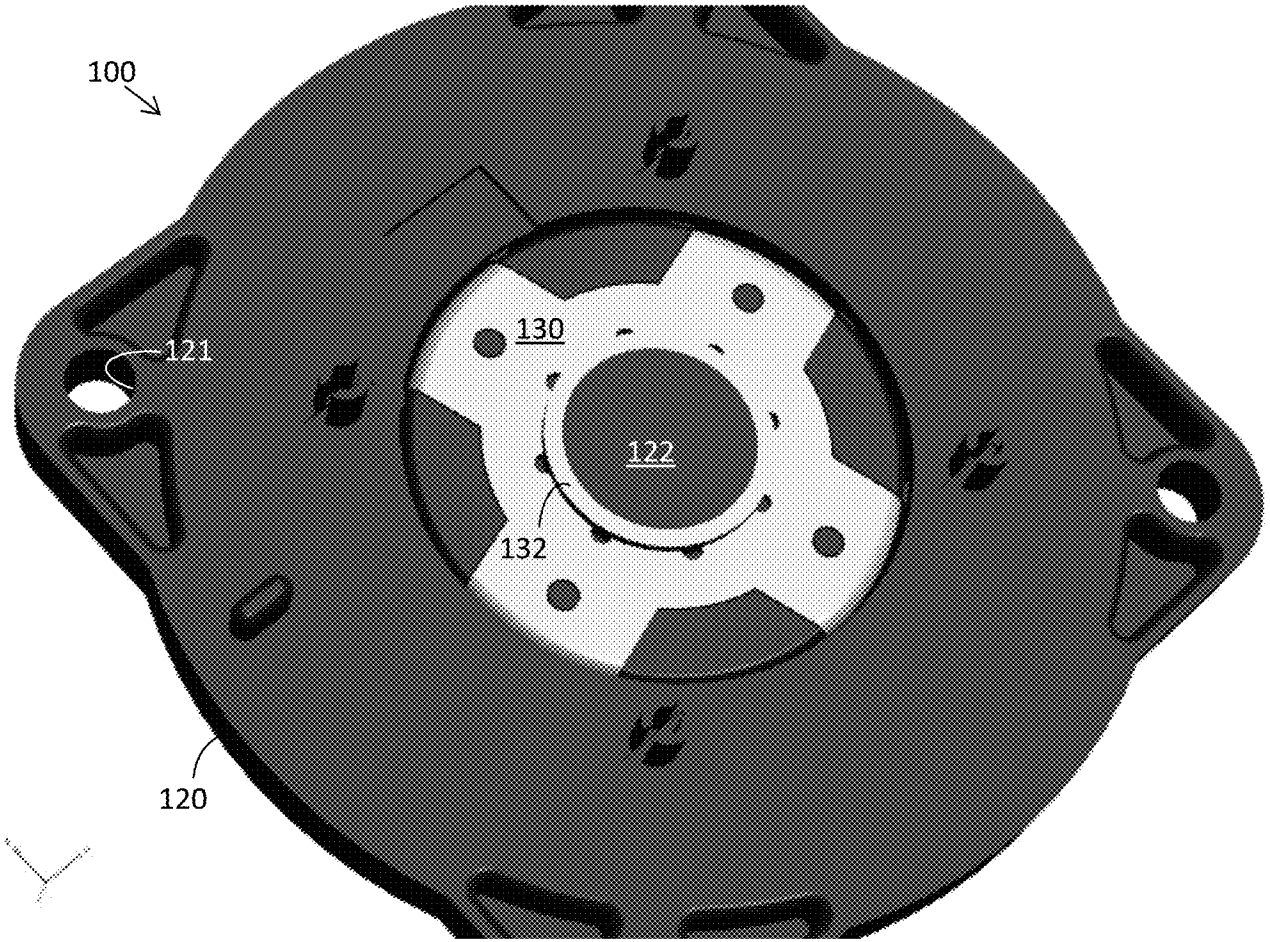
FIG. 4 illustrates an isometric view of the assembly shown in FIG. 2, with a side opposite the side shown in FIG. 2 being visible.

FIG. 4 shows an isometric view of the assembly 100 from a position generally opposite the perspective shown in FIG. 2. The visible side of the assembly 100 shown in FIG. 4 is not exposed to the working fluid passing through the pump and faces externally relative to the pump.

The housing 120 can define one or more apertures or other features arranged to secure the housing 120 and the corresponding housing and stator assembly 100 to another portion (e.g., the intermediate housing portion 330 shown in FIG. 1) of a pump and/or heat exchanger assembly. A portion of the stator 130 is visible in FIG. 4. In particular, the stator core 132 is partially visible. A motor seal 122 sealingly engages an inner surface 137 (FIG. 5) of the stator core 132 to prevent the working fluid from leaking out of the stator-cooling chamber.

Figure 5:
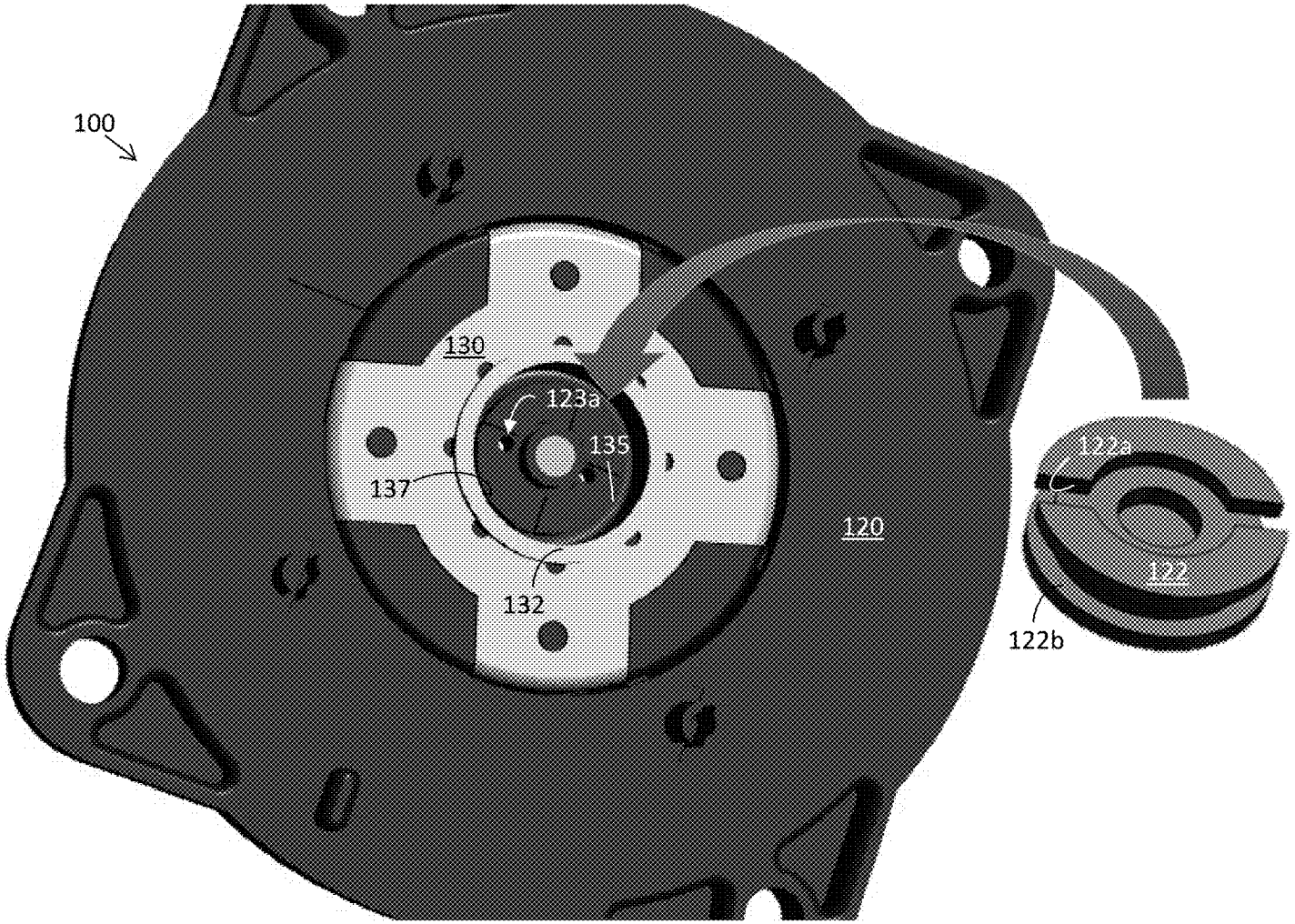
FIG. 5 illustrates an isometric view similar to that shown in FIG. 4, with a motor seal removed to expose flow channels therein.

FIG. 5 shows the motor seal 122 removed, revealing the apertures 123*a*, 123*b* from the side of the floor 124*a* opposite that shown in FIG. 3. Also visible is an O-ring 135 arranged to seal against a portion of the motor seal 122. The groove 122*a* in the motor seal 122 provides a flow path within the stator-cooling chamber from the apertures 123*a*, 123*b* to a circumferentially extending groove 122*b*, directing the working fluid over the inner surface 137 of the stator core 132. The groove 122*a* can open to a circumferentially extending groove 122*b* defined by the motor seal 122, as shown in FIG. 5, or between a pair of spaced apart O-rings, as shown by way of example in the cross-sectional view depicted in FIG. 6.

The groove 122*a* and the circumferentially extending groove 122*b* permit the working fluid to directly contact the stator 130 within the stator-cooling chamber. In particular, the working fluid is directly exposed to the interior surface 137 of the stator core 132 and can flow past that surface. As the working fluid passes over the stator, the working fluid can absorb energy from the stator 130 in the form of heat, cooling the stator. By cooling the stator 130, reliability of the electric motor can be improved. As well, efficiency of the motor can be improved by cooling the stator 130.

Referring now to the cross-section shown in FIG. 6, a flow path of the working fluid over and around the impeller 111, through the housing 120 and over the stator 130 will be described. As noted above, the impeller 111 is immersed in working fluid within a pump volute (e.g., a volute 311 shown in FIG. 1). The impeller 111 rotatably engages the bushing (or bearing) 118 and is free to rotate.

An impeller sidewall 113 extends circumferentially around the impeller 111 as depicted by way of example in FIG. 2, and is positioned within the groove 126 defined by the housing. Radially inward of the sidewall 113, a plurality of permanent magnets 134 is distributed circumferentially within the impeller sidewall at a radial position outward of the inner housing wall of the groove 126 (e.g., the magnets also are in the groove). As an electrical current passes through the coils 136 of the stator, a magnetic field is induced in the stator core 132. That magnetic field passes through the housing wall and interacts with the magnetic field of the permanent magnets 134 to urge the permanent magnets (e.g., the rotor) in rotation. Because the magnets 134 are affixed to or integral with the impeller 111, the magnetic field induced by the electric current through the coils 136 urges the impeller, by way of urging the magnets, in rotation about the shaft 116.

The sidewall 113 and magnets 134 are exposed to the working fluid in the pump volute. The impeller 113 is spaced from the housing 120. For example, the sidewall 113 is spaced radially inwardly of the outer wall of the housing recess 126, forming an annular gap, or channel, through which the working fluid can pass from the pump volute. As well, the impeller 111 is vertically (as oriented in FIG. 6) spaced apart from the floor of the recess 126, the magnets 134 are outwardly spaced from the inner wall of the recess 126, impeller 111 is spaced from the horizontal (as oriented in FIG. 6) surface 125, and the cylindrically shaped wall of the impeller 111 engaging the bushing (or bearing) 118 is inwardly spaced from the wall of the cylindrical recess 124. Thus, the channel between the impeller sidewall 113 and outer wall of the recess 126 is thus fluidicly coupled with the apertures 123*a*, 123*b*, allowing the working fluid in the pump volute to flow through the housing 120 into the stator-cooling chamber and over the stator 130.

The stator sealing cap 122 shown in the cross-sectional view in FIG. 6 differs slightly in construction from the one described above in relation to FIG. 5. In FIG. 6, two o-rings 135 urge against the stator wall 137 and define a flow path 122*b* similar to the circumferential groove in the motor sealing cap 122 described above and shown in FIG. 5.

After flowing through one of the apertures 123*a*, 123*b* in the housing 120, the working fluid can flow through the channel 122*a* and the circumferentially extending channel 122*b* defined by the motor seal. As the working fluid flows through the channels 122*a*, 122*b* (e.g., as a result of pressure gradients induced by rotation of the impeller 111 within the pump volute, different radial positions of the apertures 123*a*, 123*b*, and/or different cross-sectional areas of the apertures 123*a*, 123*b*), the working fluid enters the stator-cooling chamber, comes into direct and/or thermal contact with the stator 130 (e.g., the inner wall 137 of the stator core) and cools the stator before exhausting through the other of the aperture 123*a*, 123*b*.

In some embodiments, the stator core 132 has a thermally conductive plate 132*a* to facilitate heat transfer from the windings to the working fluid within the stator-cooling chamber flowing from one of the apertures 123*a*, 123*b*. Such a plate 132*a* is depicted in FIG. 6. Such a plate can be thermally coupled with the stator core and/or the windings and can increase the area exposed to the working fluid and thus available for heat transfer from the stator to the working fluid in the stator-cooling chamber. Such a plate can have fins or other extended heat-transfer surfaces to further improve heat transfer rates.

In some embodiments, the stator poles are positioned radially outward of the impeller 111. For example, a stator core can define an open interior region having several poles extending inwardly into the open interior region, while leaving sufficient open space within the region to receive an impeller. As described above, a housing wall (e.g., a portion of a pump volute) can be positioned between the impeller and the stator poles positioned radially outward of the impeller and housing wall. The housing wall can define one or more apertures configured to permit the coolant to flow over and/or around the stator core and/or a member thermally coupled with the stator core and windings.

The examples described above generally concern fluidic heat transfer systems configured to cool one or more electronic and/or electric components, such as, for example, an integrated circuit or a stator of an electric motor. Nonetheless, other applications for disclosed heat transfer systems are contemplated, together with any attendant changes in configuration of the disclosed apparatus. Incorporating the principles disclosed herein, it is possible to provide a wide variety of systems configured to transfer heat using a fluid circuit.

Directions and references (e.g., up, down, top, bottom, left, right, rearward, forward, etc.) may be used to facilitate discussion of the drawings but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by references in its entirety for all purposes.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of fluid heat exchange systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the disclosed inventions are not intended to be limited to the embodiments shown herein, but are to be accorded the full scope consistent with the language of this disclosure, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No element is to be construed under the provisions of 35 USC 112, sixth paragraph, unless the element is expressly recited using the phrase "means for" or "step for".

Thus, in view of the many possible embodiments to which the disclosed principles can be applied, it should be recognized that the above-described embodiments are only examples and should not be taken as limiting in scope. I therefore reserve all rights to the subject matter disclosed herein, including the right to claim all that comes within the scope and spirit of the following claims, as presently presented or amended in the future.

I currently claim:

1. An electric pump and heat exchanger assembly for cooling an integrated circuit, the electric pump and heat exchanger assembly comprising:

a housing coupled with a heat sink, wherein a primary flow path extends from an inlet port to the housing to an outlet port from the housing, wherein the primary flow path extends through a pump volute defined by the housing and a plurality of channels defined by the heat sink, wherein the heat sink is configured to absorb heat dissipated by an integrated circuit and to convey the heat to a liquid coolant flowing along the primary flow path;

a stator having a stator core defining a plurality of poles, a coil of electrically conductive material extending around one or more of the plurality of poles;

an impeller defining an axis of rotation and positioned within the pump volute;

a plurality of permanent magnets coupled with the impeller, arranged circumferentially around the axis-of-rotation, and radially spaced apart from the plurality of poles;

a stator-cooling chamber, wherein a wall of the stator core is exposed to the stator-cooling chamber and configured to provide contact between a liquid coolant in the stator-cooling chamber and the stator core to facilitate heat transfer from the stator core and/or the coils to the liquid coolant; and a wall of the housing positioned between the impeller and the stator-cooling chamber, wherein the wall of the housing defines a first aperture and second aperture, wherein a secondary flow path extends from the pump volute through the first aperture, into the stator-cooling chamber and through the second aperture to pump volute, wherein a radial position of the first aperture differs from a radial position of the second aperture, and wherein the second aperture is positioned circumferentially opposite the first aperture relative to the axis-of-rotation.

2. The electric pump and heat exchanger assembly according to claim 1, further comprising a liquid coolant occupying the pump volute and the stator-cooling chamber, wherein a cross-sectional area of the first aperture differs from a cross-sectional area of the second aperture, and wherein the difference in cross-sectional areas gives rise to sufficient pressure gradients within the liquid coolant to facilitate a flow of the liquid coolant through the stator-cooling chamber.

3. The electric pump and heat exchanger assembly according to claim 1, further comprising a motor seal, wherein the stator core defines an open interior region having one or more walls at least partially defining the stator-cooling chamber, wherein the motor seal matingly engages with the open interior region to provide a leak-resistant seal and further defines one or more grooves configured to convey the liquid coolant over a region thermally coupled with the stator core.

4. The electric pump and heat exchanger assembly according to claim 3, wherein the housing wall, a cylindrical wall of the stator core, and the motor seal define outer boundaries of the stator-cooling chamber.

5. The electric pump and heat exchanger assembly according to claim 3, wherein at least one of the one or more grooves extends circumferentially around the motor seal, and wherein the at least one groove is configured to convey the liquid coolant through a flow path in direct contact with the wall defined by the stator core.

6. The electric pump and heat exchanger assembly according to claim 5, wherein the at least one groove is a first groove, and wherein the motor seal defines a second groove providing a flow path within the stator-cooling chamber from the first aperture to the first groove and from the first groove to the second aperture.

7. The electric pump and heat exchanger assembly according to claim 1, further comprising a heat-transfer plate positioned within the stator-cooling chamber, wherein the heat-transfer plate is thermally coupled to the stator core and/or the coils and defines an effective heat-transfer area.

8. The electric pump and heat exchanger assembly according to claim 7, wherein the heat-transfer plate comprises a plurality of extended heat-transfer features having an effective heat-transfer area greater than twice an effective heat-transfer area of a heat-transfer plate lacking the plurality of extended heat-transfer surfaces.

9. The electric pump and heat exchanger assembly according to claim 1, wherein the impeller has an inner course of circumferentially distributed straight impeller blades and an outer course of circumferentially distributed straight impeller blades positioned at least partially radially outward of the inner course of straight impeller blades.

10. The electric pump and heat exchanger assembly according to claim 1, wherein the wall defines a plurality of apertures configured relative to each other to provide sufficient pressure gradients within the liquid coolant to urge the liquid coolant through the stator-cooling chamber.

11. The electric pump and heat exchanger assembly according to claim 10, wherein a radial position or a cross-sectional area of one of the plurality of apertures differs from a radial position or a cross-sectional area, respectively, of at least one other of the plurality of apertures.

12. The electric pump and heat exchanger assembly according to claim 1, wherein the wall defines a cylindrical central recess, coaxial with the axis of rotation, having a floor and an outer recess wall, wherein the first and second apertures are defined in and extend through the floor to convey the liquid coolant to and from the stator cooling chamber, respectively.

13. An electric pump and heat exchanger assembly for cooling an integrated circuit, the electric pump and heat exchanger assembly comprising:

a stator having a stator core defining a plurality of poles, a coil of electrically conductive material extending around each respective one of the plurality of poles;

an impeller defining an axis of rotation;

a plurality of permanent magnets coupled with the impeller, arranged circumferentially around the axis-of-rotation, and radially spaced apart from the plurality of poles; and a housing defining a wall positioned between the stator-cooling chamber and a first region at least partially occupied by the impeller, wherein the wall defines a first aperture and a second aperture, wherein a secondary flow path through the housing extends from the first aperture to the second aperture such that the secondary flow path conveys the liquid coolant from the first region into the stator-cooling chamber and returns the liquid coolant from the stator-cooling chamber to the first region, wherein the stator-cooling chamber is configured to facilitate heat transfer from the stator core and/or the coils to the liquid coolant in the stator-cooling chamber;

wherein a radial position of the first aperture differs from a radial position of the second aperture, and wherein the second aperture is positioned circumferentially opposite the first aperture relative to the axis of rotation;

a liquid coolant occupying the first region and the stator-cooling chamber, wherein the difference in radial positions of the first and second apertures gives rise to sufficient pressure gradients within the liquid coolant to urge a flow of the liquid coolant through the stator-cooling chamber;

a motor seal, wherein the stator core defines an open interior region having one or more walls, wherein the motor seal matingly engages with the open interior region to provide a leak-resistant seal and further defines one or more grooves configured to convey a liquid coolant over a region thermally coupled with the stator core, wherein the housing wall, a wall of the stator core, and the motor seal define outer boundaries of the stator-cooling chamber, wherein at least one of the grooves extends around a perimeter of the motor seal, and wherein the at least one groove is configured to convey the liquid coolant through a flow path in direct contact with at least one of the one or more walls of the stator core;

a heat-transfer plate positioned within the stator-cooling chamber, wherein the heat-transfer plate is thermally coupled to the stator core and/or the coils and defines an effective heat-transfer area; and a heat exchanger arranged to receive a liquid coolant from the first region and to facilitate a transfer of heat from an integrated circuit to the liquid coolant, wherein the housing further defines a primary flow path configured to convey the liquid coolant from the first region to the heat exchanger and from the heat exchanger to an exhaust port from the housing.

14. An electric pump and heat exchanger assembly comprising:

a stator having a stator core defining a plurality of poles;

a coil of electrically conductive material extending around one or more of the plurality of poles;

a stator-cooling chamber and a liquid coolant in the stator-cooling chamber;

an impeller defining an axis of rotation;

a plurality of permanent magnets coupled with the impeller, arranged circumferentially around the axis-of-rotation, and radially spaced apart from the plurality of poles;

a first region at least partially occupied by the impeller and the liquid coolant; and a wall positioned between the impeller and the stator-cooling chamber fluidically coupling, the first region with the stator-cooling chamber, wherein the wall defines a first aperture configured to convey the liquid coolant from the first region into the stator-cooling chamber and a second aperture configured to convey the liquid coolant from the stator-cooling chamber into the first region, wherein the stator-cooling chamber is configured to convey the liquid coolant from the first aperture to the second aperture through a flow path in direct contact with the stator core, wherein a radial position of the first aperture differs from a radial position of the second aperture, and wherein the second aperture is positioned circumferentially opposite the first aperture relative to the axis of rotation.

15. An electric pump and heat exchanger assembly comprising:

a stator having a stator core defining a plurality of poles, a coil of electrically conductive material extending around one or more of the plurality of poles, and a stator-cooling chamber;

an impeller defining an axis of rotation;

a plurality of permanent magnets coupled with the impeller, arranged circumferentially around the axis-of-rotation, and radially spaced apart from the plurality of poles;

a first region at least partially occupied by the impeller and so fluidically coupled with the stator-cooling chamber as to be configured to convey a liquid coolant from the first region into the stator-cooling chamber, wherein a wall of the stator core is exposed to the stator-cooling chamber and configured to provide contact between a liquid coolant and the stator core to facilitate heat transfer from the stator core and/or the coils to the liquid coolant;

a housing defining a wall positioned between the impeller and the stator-cooling chamber, wherein the wall defines a first aperture configured to convey the liquid coolant from the first region into the stator-cooling chamber and a second aperture configured to convey the liquid coolant from the stator-cooling chamber into the first region; and a motor seal, wherein the stator core defines an open interior region having one or more walls at least partially defining the stator-cooling chamber, wherein the motor seal matingly engages with the open interior region to provide a leak-resistant seal and further defines a first groove configured to convey the liquid coolant around a circumference of the motor seal, and a second groove configured to convey the liquid coolant from the first aperture to the first groove and from the first groove to the second aperture, wherein the first groove conveys the liquid coolant to contact the stator core.

* * * * *